US006340144B1

(12) United States Patent
Shuen

(10) Patent No.: US 6,340,144 B1
(45) Date of Patent: Jan. 22, 2002

(54) DECORATIVE STRUCTURE FOR CAR EXHAUST PIPE

(75) Inventor: Shun Tian Shuen, San Chung (TW)

(73) Assignee: Janchy Enterprises Co., Ltd., Taipei (TW)

( * ) Notice: Subject to any disclaimer, the term of this patent is extended or adjusted under 35 U.S.C. 154(b) by 0 days.

(21) Appl. No.: 09/640,996

(22) Filed: Aug. 18, 2000

(51) Int. Cl.[7] ..... E04G 3/00
(52) U.S. Cl. ..... 248/205.1; 248/278.1
(58) Field of Search ..... 248/205.1, 214, 248/229.17, 228.8, 279.1, 278.1, 274.1; 220/724; 137/382; 454/5

(56) References Cited

U.S. PATENT DOCUMENTS 4,226,173 A * 10/1980 Khosropour ..... 220/724 X
5,960,865 A * 10/1999 Costa et al. ..... 248/229.14 X

* cited by examiner

*Primary Examiner*—Ramon O. Ramirez
(74) *Attorney, Agent, or Firm*—Bacon & Thomas, PLLC

(57) ABSTRACT

Decorative structure for car exhaust pipe, including a freely swingable panel block for a user to mount a decorative article on a surface thereof as desired, an adjusting unit which is freely adjustable in length in accordance with the length of the exhaust pipe and a fastening ring which is adjustable in inner diameter in accordance with the diameter of the exhaust pipe. The decorative structure can be installed on various types of car exhaust pipes with different specifications and diameters to achieve a decorative and beautifying effect.

7 Claims, 13 Drawing Sheets

DECORATIVE STRUCTURE FOR CAR EXHAUST PIPE

BACKGROUND OF THE INVENTION

The present invention relates to a decorative structure for car exhaust pipe, which is freely adjustable in dimension in accordance with the specifications of various types of car exhaust pipes. The decorative structure can be easily detachably installed on various types of car exhaust pipes with different specifications and diameters to achieve a decorative and beautifying effect.

A conventional exhaust pipe structure of a car generally is designed with one single pipe. In order to enhance the power output of the car, some exhaust pipe structures are designed with double pipes or even more pipes. Such exhaust pipe structure can also achieve a decoration effect. However, the conventional exhaust pipe only has specific usage and is designed with monotonous appearance and lacks novelty.

SUMMARY OF THE INVENTION

It is therefore a primary object of the present invention to provide a decorative structure applicable to various types and specifications of car exhaust pipes with one or more pipe. The decorative structure includes a freely swingable panel block for a user to mount a decorative article on a surface thereof as desired, an adjusting unit which is freely adjustable in length in accordance with the length of the exhaust pipe and a fastening ring which is adjustable in inner diameter in accordance with the diameter of the exhaust pipe. The decorative structure can be installed on various types of car exhaust pipes to achieve a decorative and beautifying effect.

The present invention can be best understood through the following description and accompanying drawings wherein:

DETAILED DESCRIPTION OF THE PREFERRED EMBODIMENTS

Figure 1:
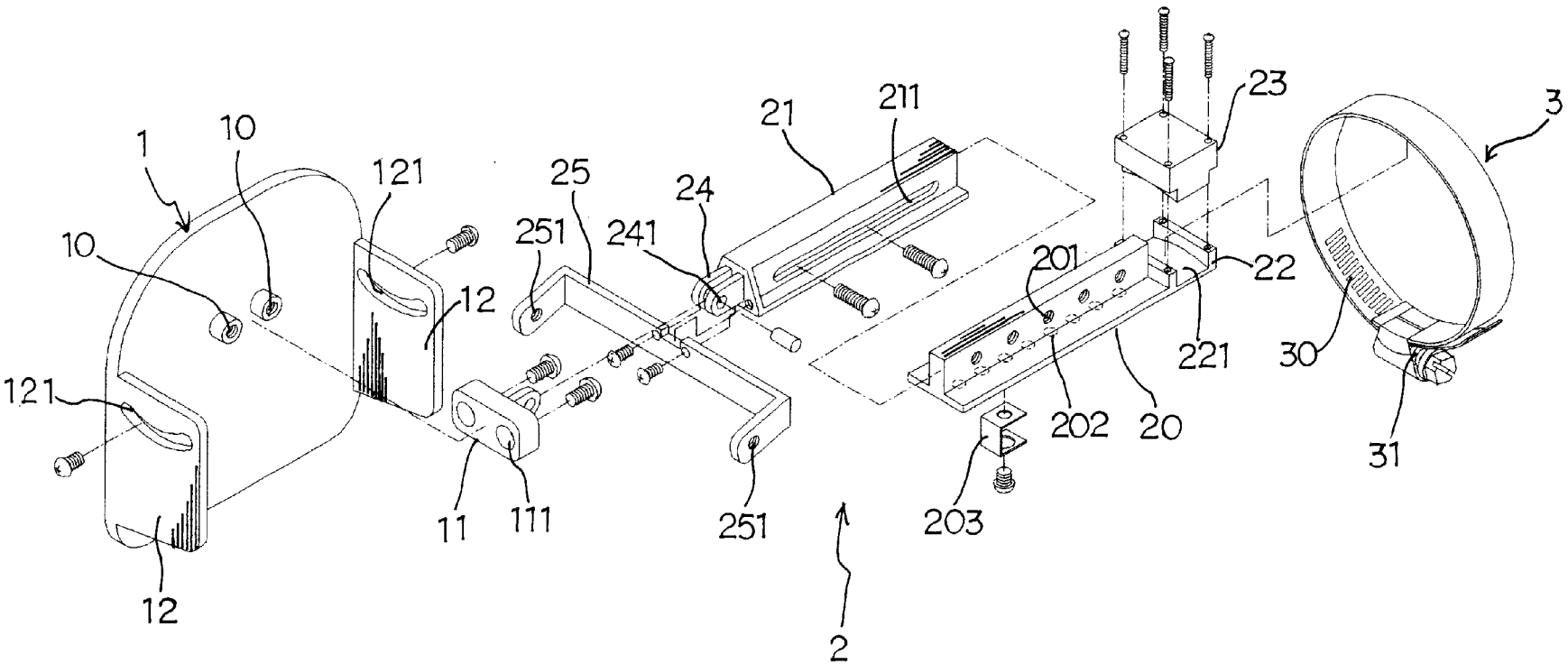
FIG. 1 is a perspective exploded view of a first embodiment of the present invention.
Figure 2:
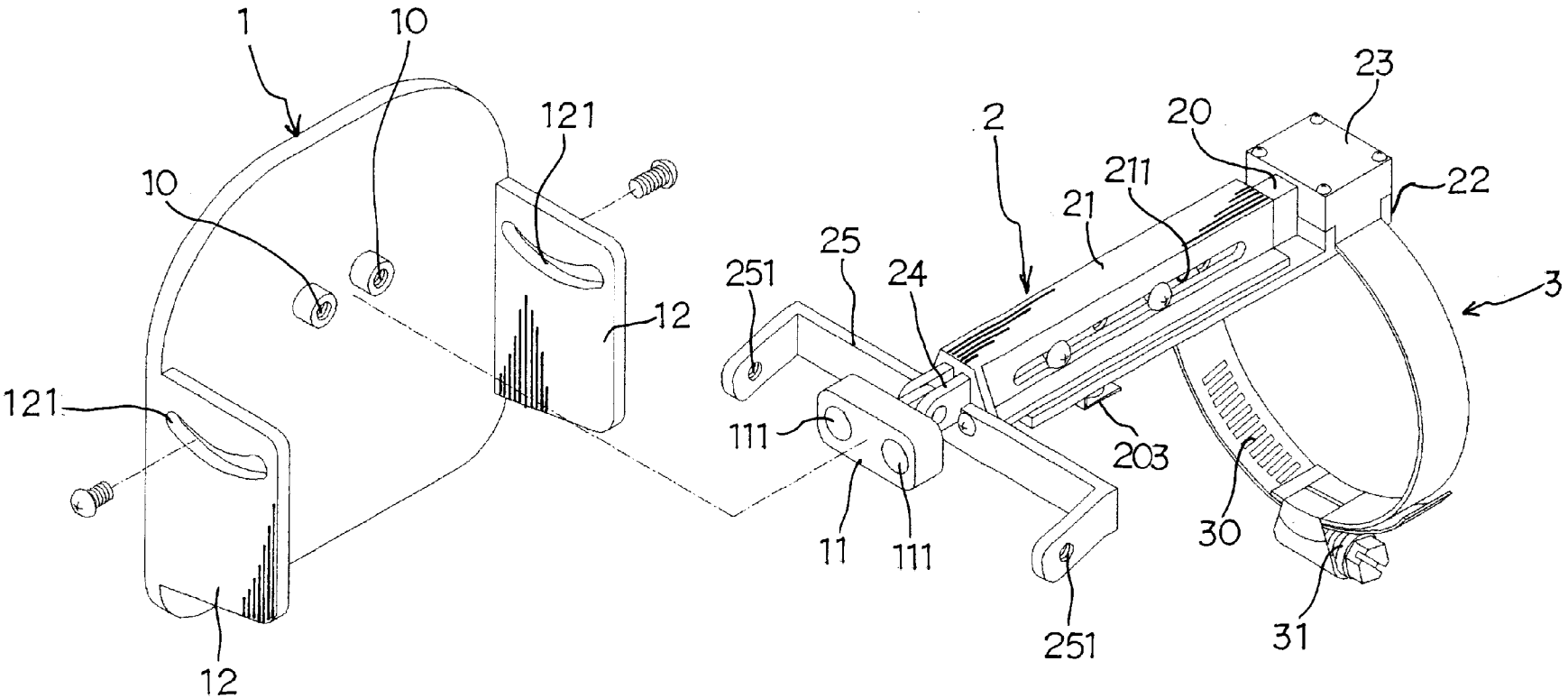
FIG. 2 is a perspective partially exploded view of the first embodiment of the present invention.

Please refer to FIG. 1. The decorative structure for car exhaust pipe of the present invention includes a panel block 1, an adjusting unit 2 and a fastening ring 3.

The panel block 1 is a rectangular panel body. A decorative picture can be fixedly disposed on the surface of the panel block 1 by screws or an adhesive. The back face of the panel block 1 is formed with a set of thread holes 10. A pivot block 11 having corresponding through holes 111 is locked at the thread holes 10 by screws. In addition, two sides of the back face of the panel block 1 are formed with projecting connecting wings 12 opposite to each other. Each connecting wing 12 is formed with an arch slot 121.

Figure 4:
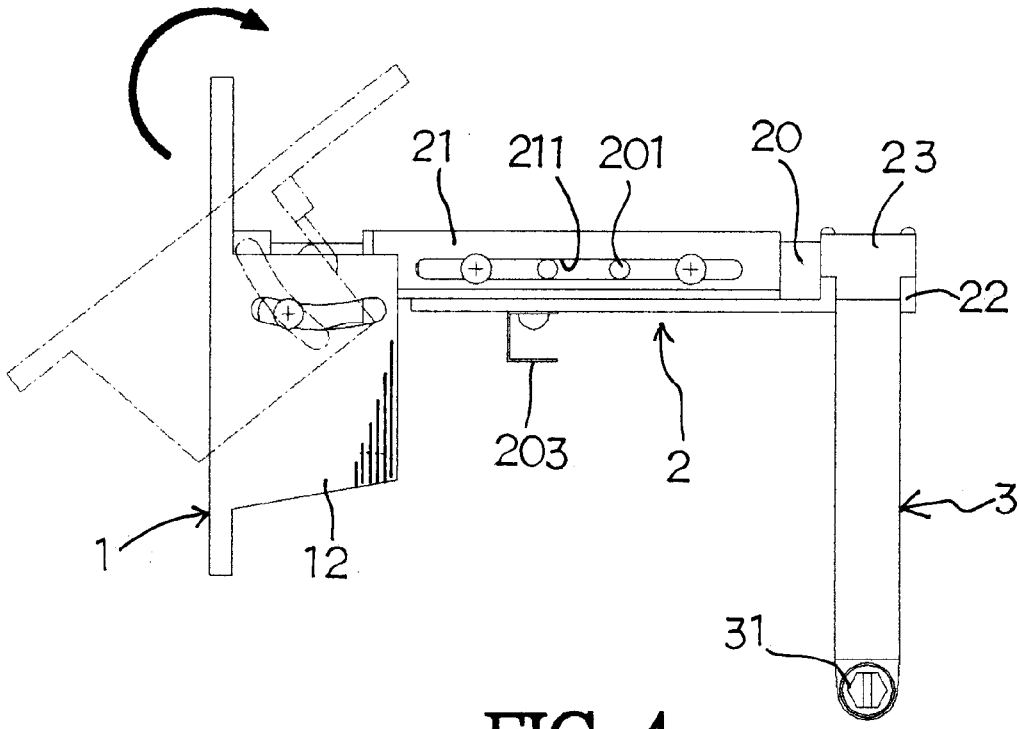
FIG. 4 is a plane view of the first embodiment of the present invention, showing the adjustment thereof in one state.
Figure 5:
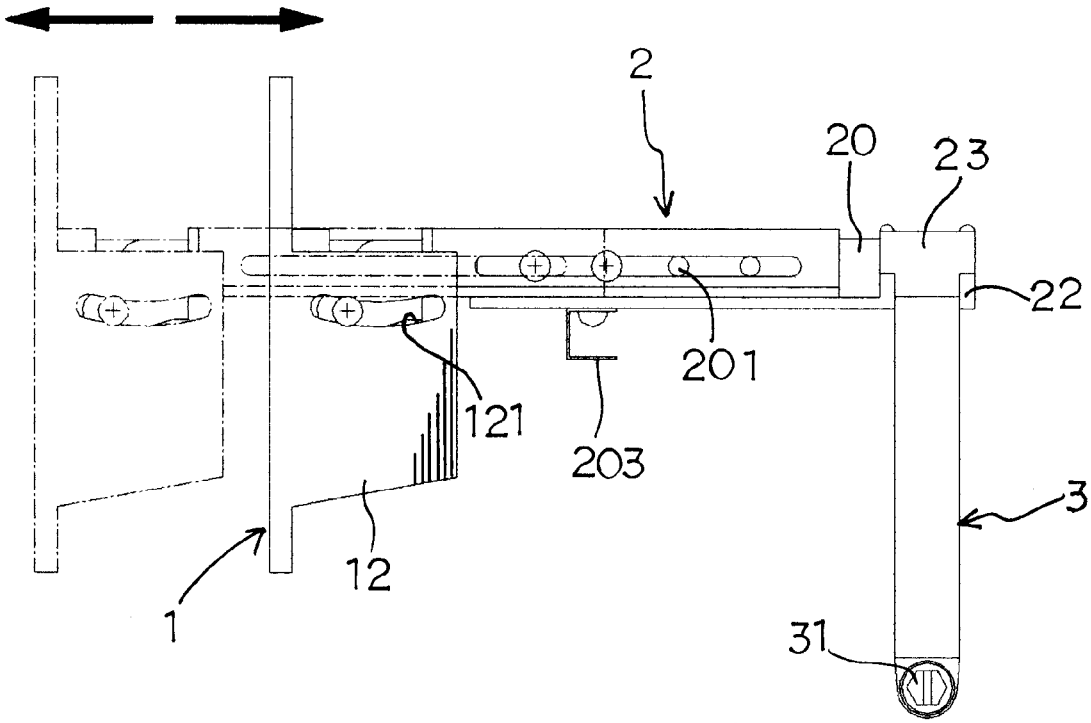
FIG. 5 is a plane view of the first embodiment of the present invention, showing the adjustment thereof in another state.

The adjusting unit 2 includes a fixing bar 20 having a reverse T-shaped cross-section and a slide bar 21 having a reverse U-shaped cross-section. The fixing bar 20 and the slide bar 21 are fitted with each other. A central swelling section of the fixing bar 20 is formed with multiple through locating holes 201. The bottom face of the fixing bar 20 is formed with multiple shallow circular dents 202 for fixing a restricting member 203 having a U-shaped cross-section. One end of the fixing bar 20 is formed with a fixing section 22 having a recess with arch face for the fastening ring 3 to inlay. A fixing block 23 is mated with the arch face and locked in the recess by screws. Two lateral sides of the slide bar 21 are formed with slots 211 corresponding to the locating holes 201, whereby when the slide bar 21 is fitted with the fixing bar 20, screws are passed through the slots 211 and the locating holes 201 to lock the slide bar 21 on the fixing bar 20 with the length adjustable as shown in FIG. 5. One end of the slide bar 21 is formed with a pair of lugs 24 having aligned through holes 241. A U-shaped connecting lever 25 is locked under the lugs 24. Two arms of the connecting lever 25 are formed with orifices 251 corresponding to the arch slots 121 of two connecting wings 12 of the panel block 1 for screws to pass therethrough and tightly locate the panel block 1. Accordingly, the angle of the panel block 1 can be freely adjusted along the arch of the slots 121 (as shown in FIG. 4).

Referring to FIG. 1, the fastening ring 3 is a resilient metal sheet which is curled into a hoop. The fastening ring 3 is formed with multiple adjusting bores 30 arranged at equal intervals from one end of the fastening ring 3 by a certain distance. A screw adjuster 31 is disposed at the overlapping sections of two ends of the fastening ring 3. When the screw adjuster 31 is turned clockwise, the inner diameter of the fastening ring 3 is gradually reduced, while being turned counterclockwise, the inner diameter thereof is gradually enlarged. Therefore, the decorative structure is applicable to various types and specifications of exhaust pipes.

Figure 3:
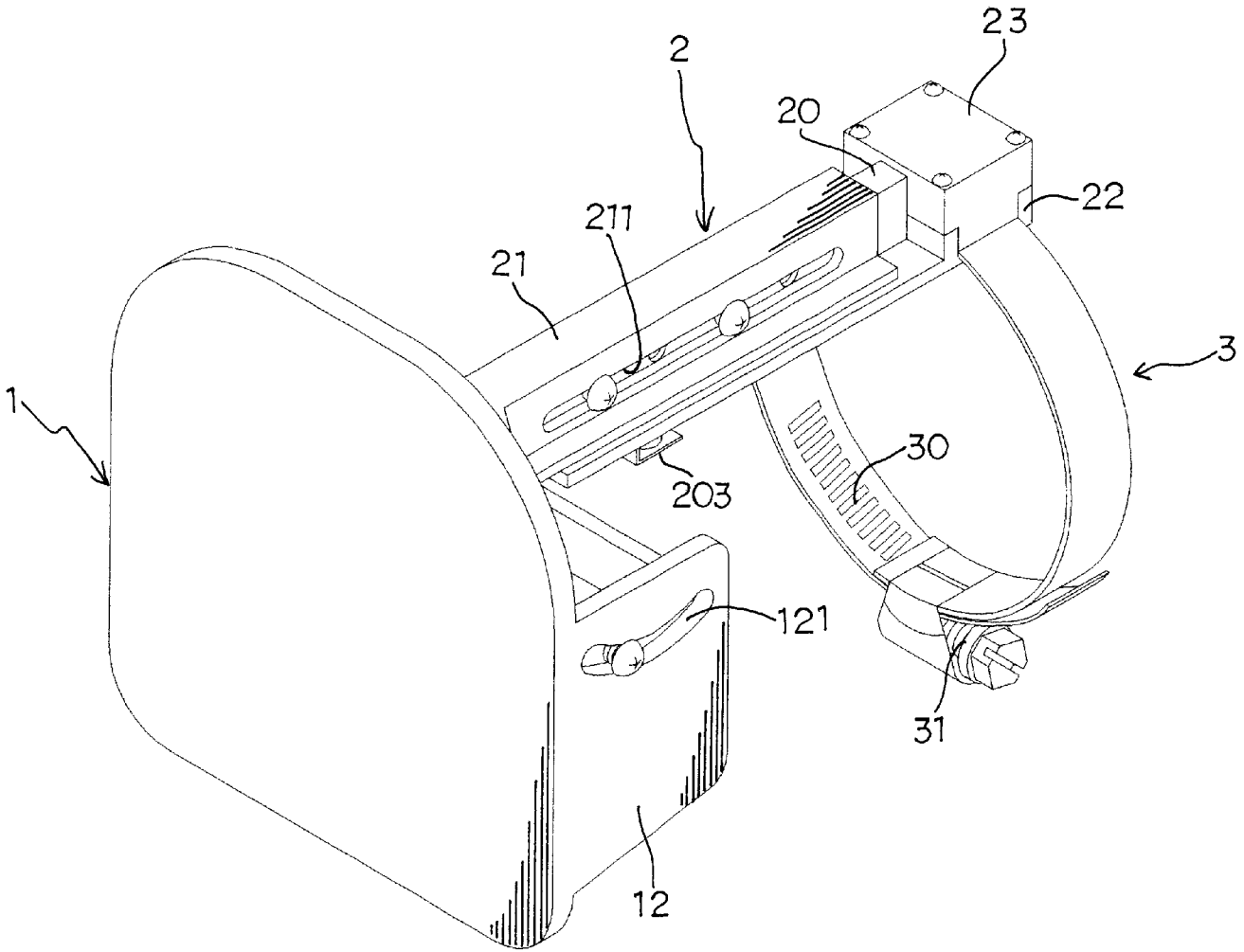
FIG. 3 is a perspective assembled view of the first embodiment of the present invention.

The above components are assembled to form the decorative structure for the exhaust pipe as shown in FIG. 3.

Figure 6:
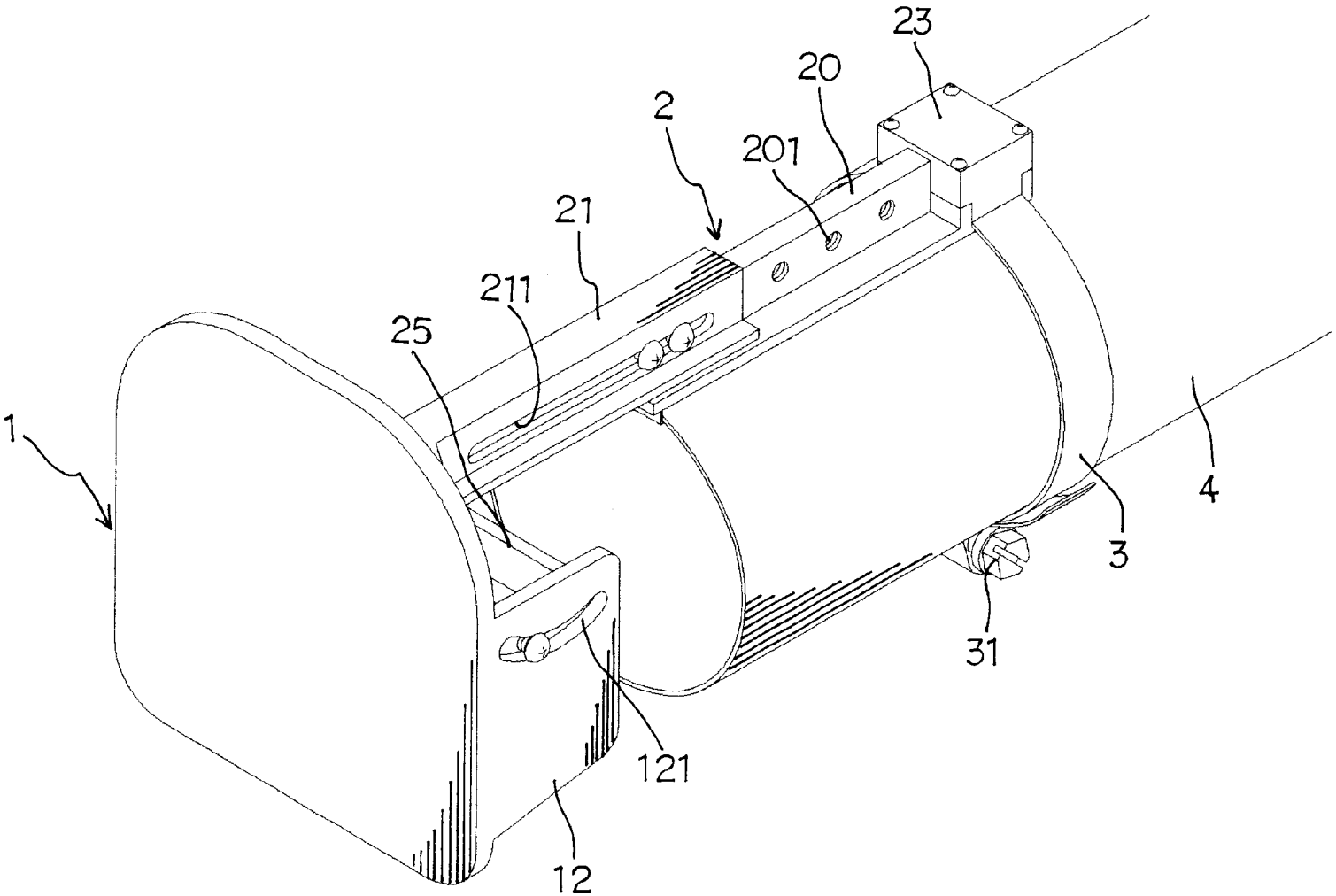
FIG. 6 is an enlarged view showing the application of the first embodiment of the present invention to a car exhaust pipe.
Figure 7:
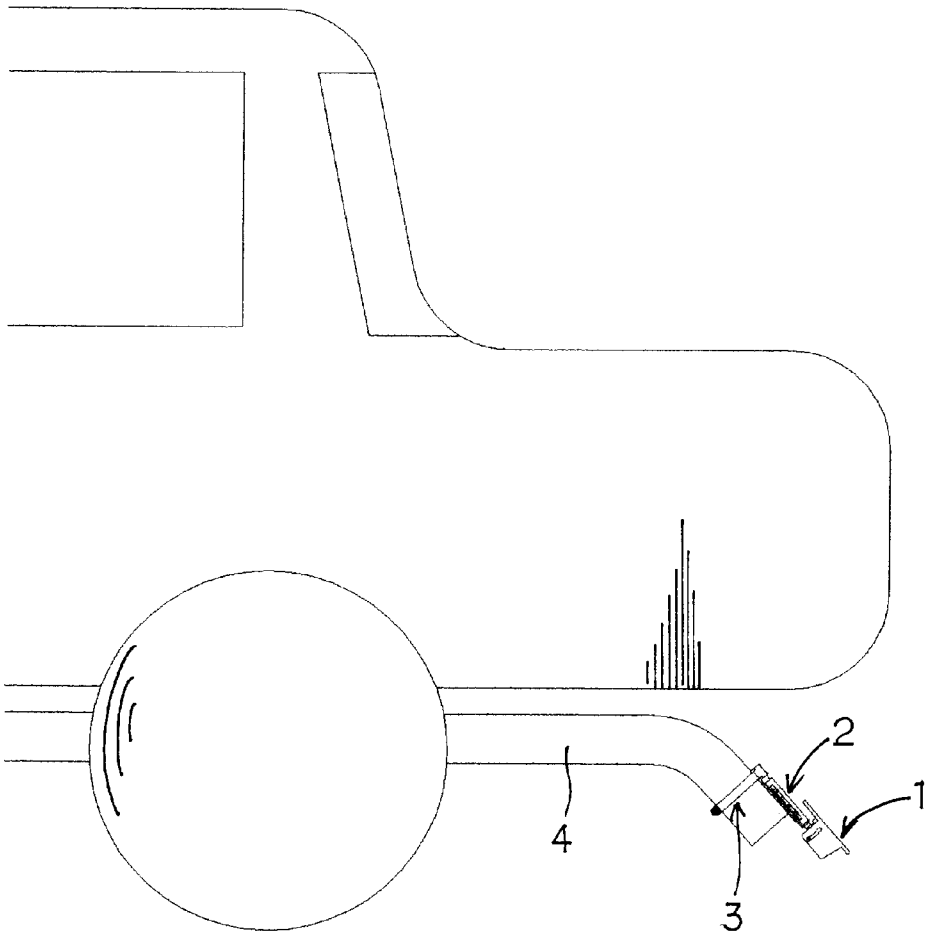
FIG. 7 shows the application of the first embodiment of the present invention to a car exhaust pipe.

Referring to FIGS. 6 and 7, when installed, the decorative structure is mounted at the exit end of the car exhaust pipe 4 with the exhaust pipe 4 passed through the fastening ring 3 and with the end edge of the exhaust pipe 4 fixedly abutting against the U-shaped restricting member 203 under the fixing bar 20. Then the inner diameter of the fastening ring 3 is adjusted by means of the screw adjuster 31 so as to firmly and quickly fasten the exhaust pipe 4.

The fastening ring 3 and the adjusting unit 2 of the present invention can be easily adjusted in accordance with various specifications of car exhaust pipes 4 so that it is easy to install and detach the decorative structure. Furthermore, different patterns of decorative articles or picture pieces can be freely added to the surface of the panel block 1 and locked thereon by screws or adhered thereto by double-face glue. The decorative articles or picture pieces can be conveniently replaced as desired to highlight personal style and taste.

Figure 8:
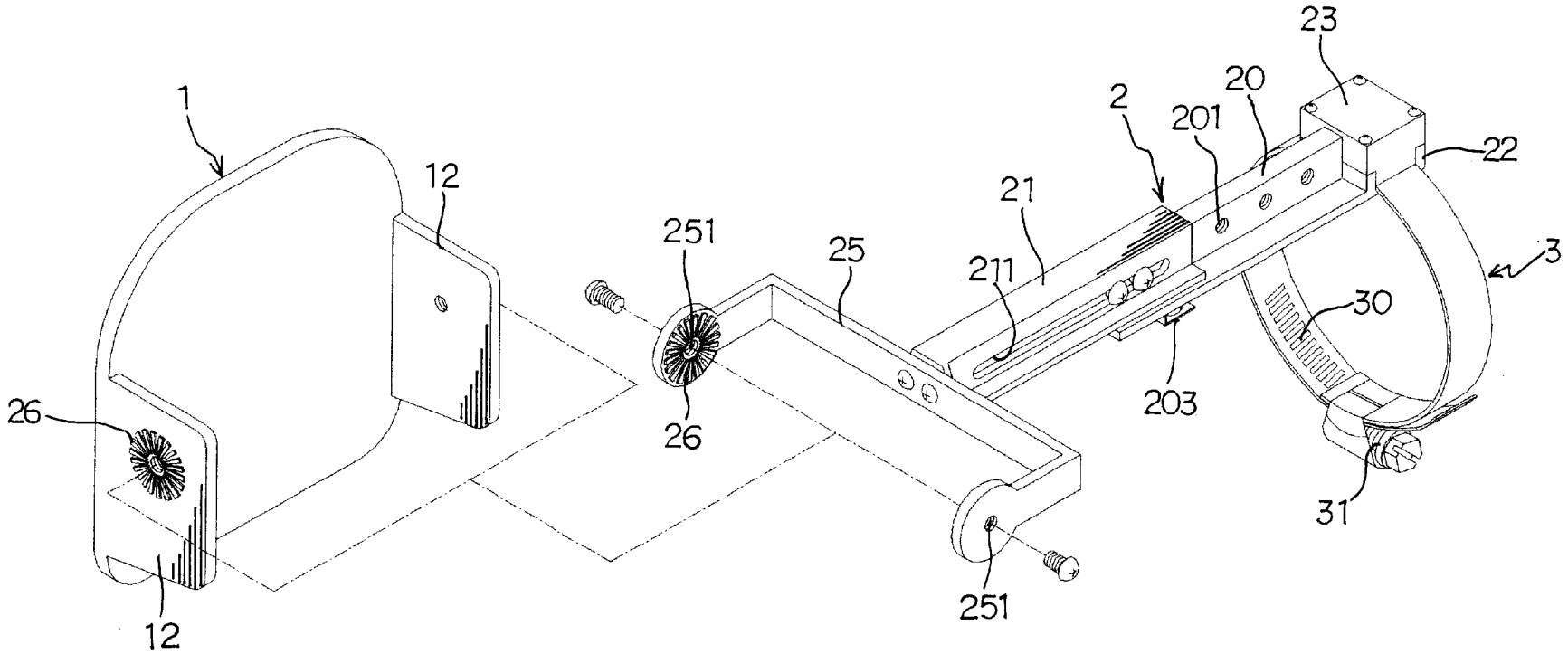
FIG. 8 is a perspective partially exploded view of a second embodiment of the present invention.
Figure 9:
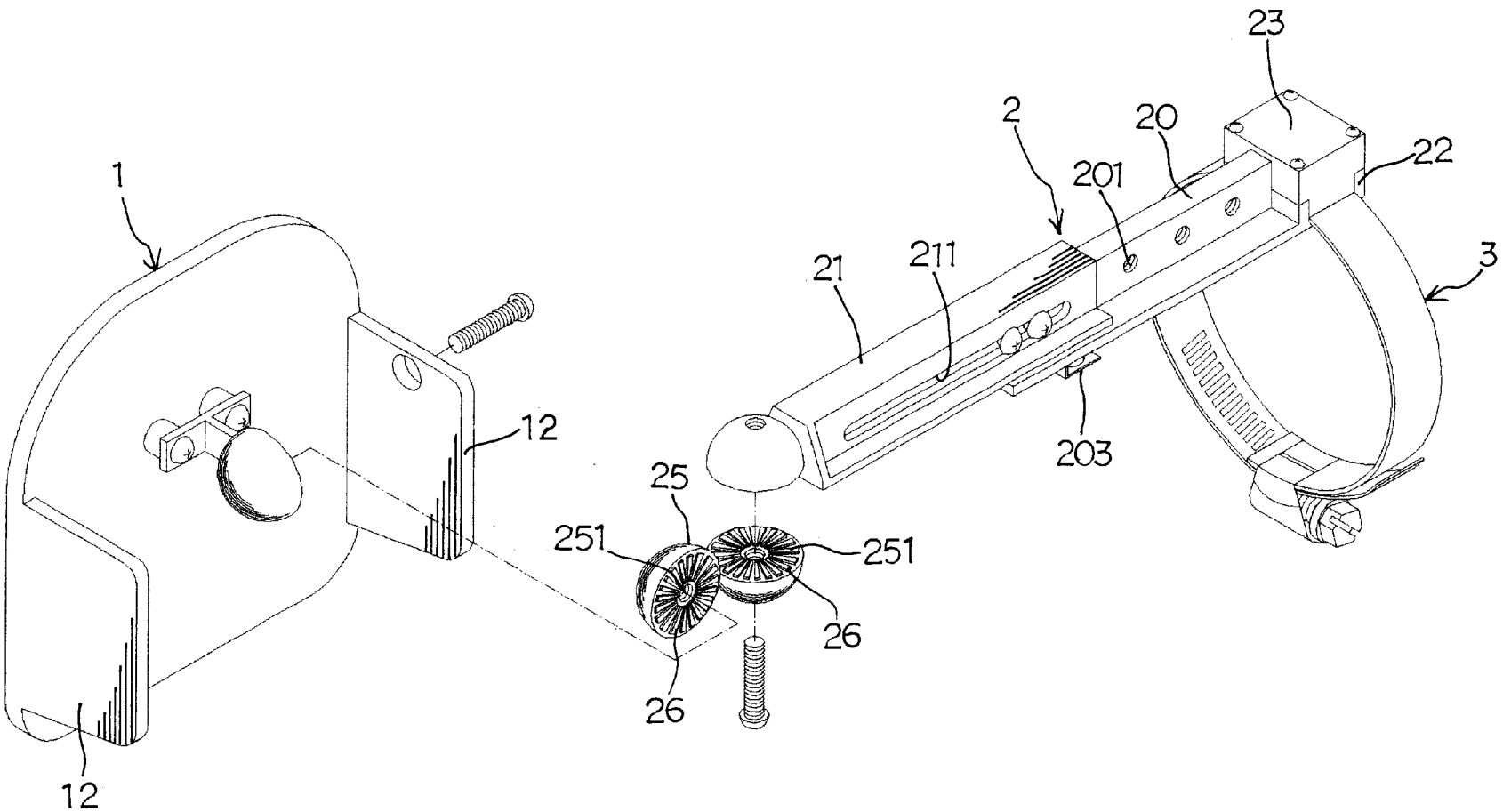
FIG. 9 is a perspective partially exploded view of a third embodiment of the present invention.
Figure 10:
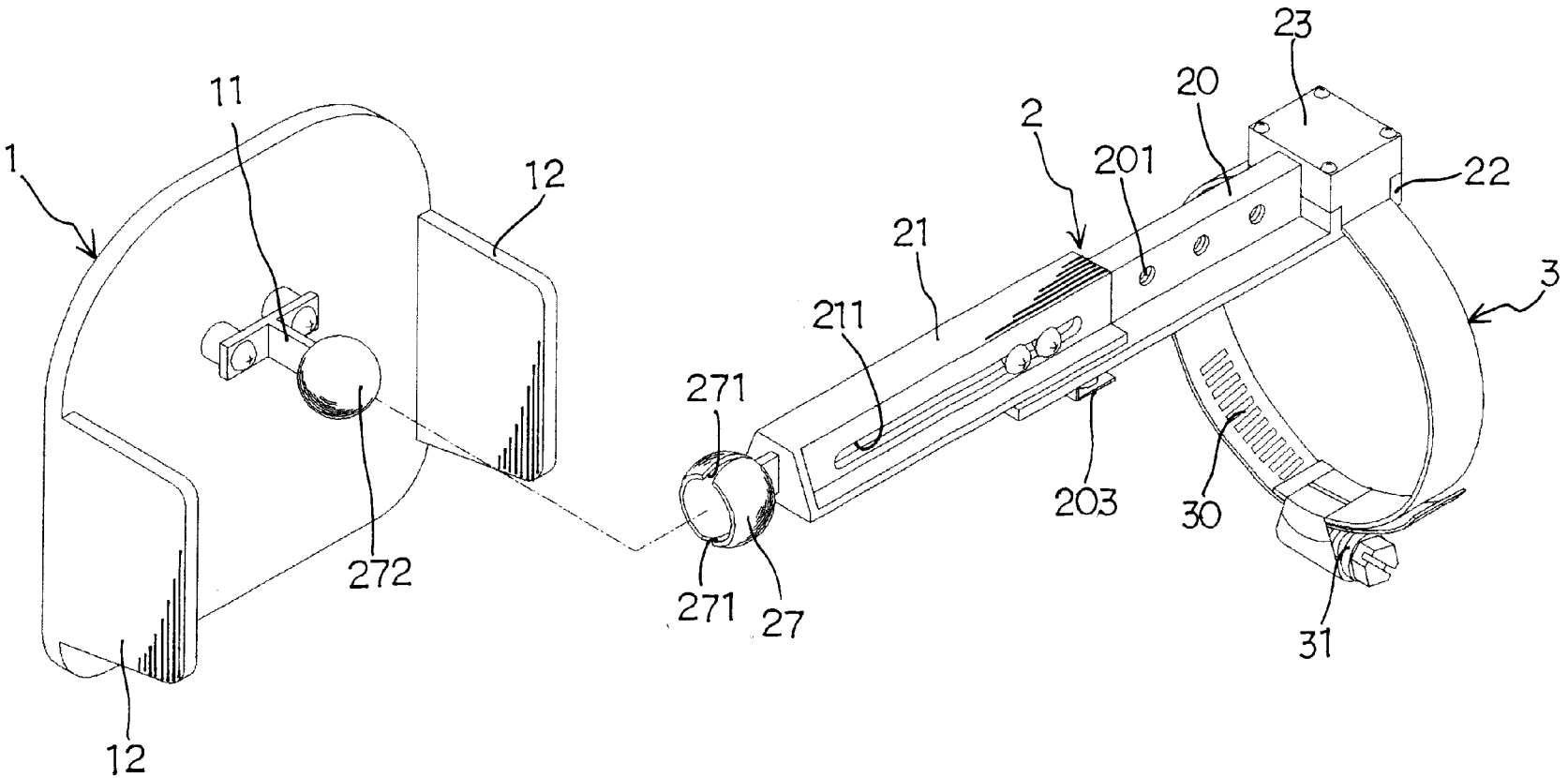
FIG. 10 is a perspective partially exploded view of a fourth embodiment of the present invention.

FIGS. 8, 9 and 10 respectively show a second, a third and a fourth embodiment of the present invention. In FIG. 8, the panel block 1 is connected with the adjusting unit 2 by an alternative structure. The opposite faces of two arms of the connecting lever 25 are formed with toothed faces 26 around the orifices 251. The connecting wings 12 of the panel block 1 are also formed with toothed faces 26 corresponding to the toothed faces 26 of the connecting lever 25. Accordingly, the panel block and the connecting lever are not so tightly locked by screws and the toothed faces 26 are engaged with each other, permitting a user to freely adjust the angle. In FIG. 9, the connecting bar 25 is replaced by two semispherical bodies intersecting each other by 90 degrees. The plane faces of the two semispherical bodies formed with toothed faces 26. The lugs 24 of one end of the slide bar 21 and the pivot block 11 of the back face of the panel block 1 are replaced by two semispherical bodies formed with the toothed faces 26 for cooperating with the above semispherical bodies. In FIG. 10, the connecting lever 25 is omitted and one end of the slide bar 21 is alternatively disposed with a spherical cavity 27. The wall of the spherical cavity 27 is formed with lengthwise opposite splits 271. The pivot block 11 on the back face of the panel block 1 is replaced by a ball body 272 for fitting into the spherical cavity 27. Accordingly, it is more easy to manufacture and assemble the decorative structure.

Figure 11:
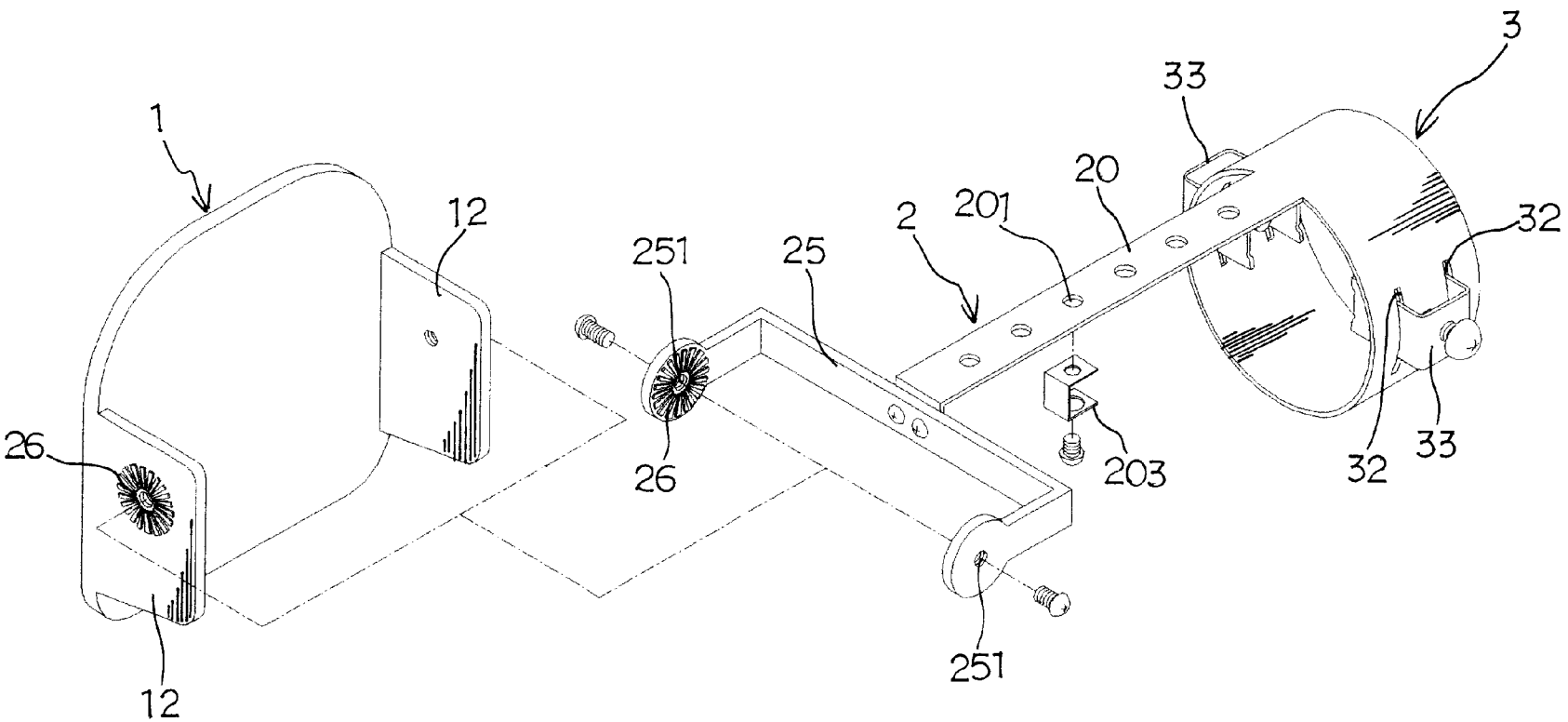
FIG. 11 is a perspective partially exploded view of a fifth embodiment of the resent invention.
Figure 12:
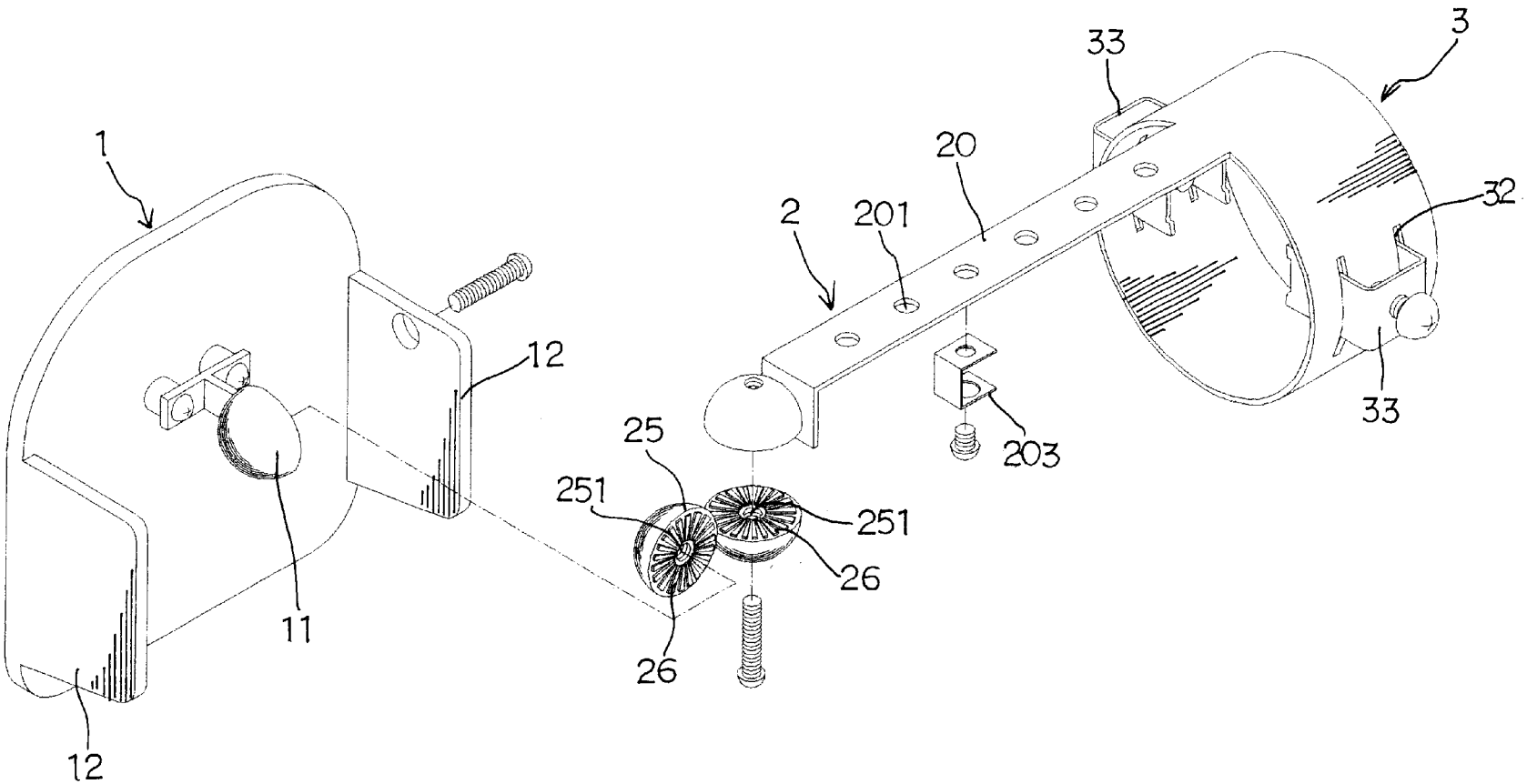
FIG. 12 is a perspective partially exploded view of a sixth embodiment of the resent invention.

FIGS. 11 and 12 further respectively show two simplified structures derived from the second and third embodiments, in which the fastening ring 3 and the adjusting unit 2 are improved. The adjusting unit 2 is only one single fixing bar 20 with a fastening ring 3 integrally formed at one end thereof. The other end of the fixing bar 20 is locked with a connecting lever 25 two arms of which are formed with toothed faces 26. The fixing bar 20 is also formed with multiple locating holes 201. A restricting member 203 is locked under the fixing bar 20. The circumference of the fastening ring 3 is formed with opposite slits 32 in each of which a clip plate 33 is inserted. The clip plate 33 is adjustable by a screw. Accordingly, the fastening ring 3 is fitted around the exhaust pipe 4 and the opposite clip plates 33 are adjusted via the screws to fixedly clip the exhaust pipe 4. The end of the wall of the exhaust pipe 4 abuts against the restricting member 203 so as to truly locate the decorative structure without swinging and displacement.

Figure 13:
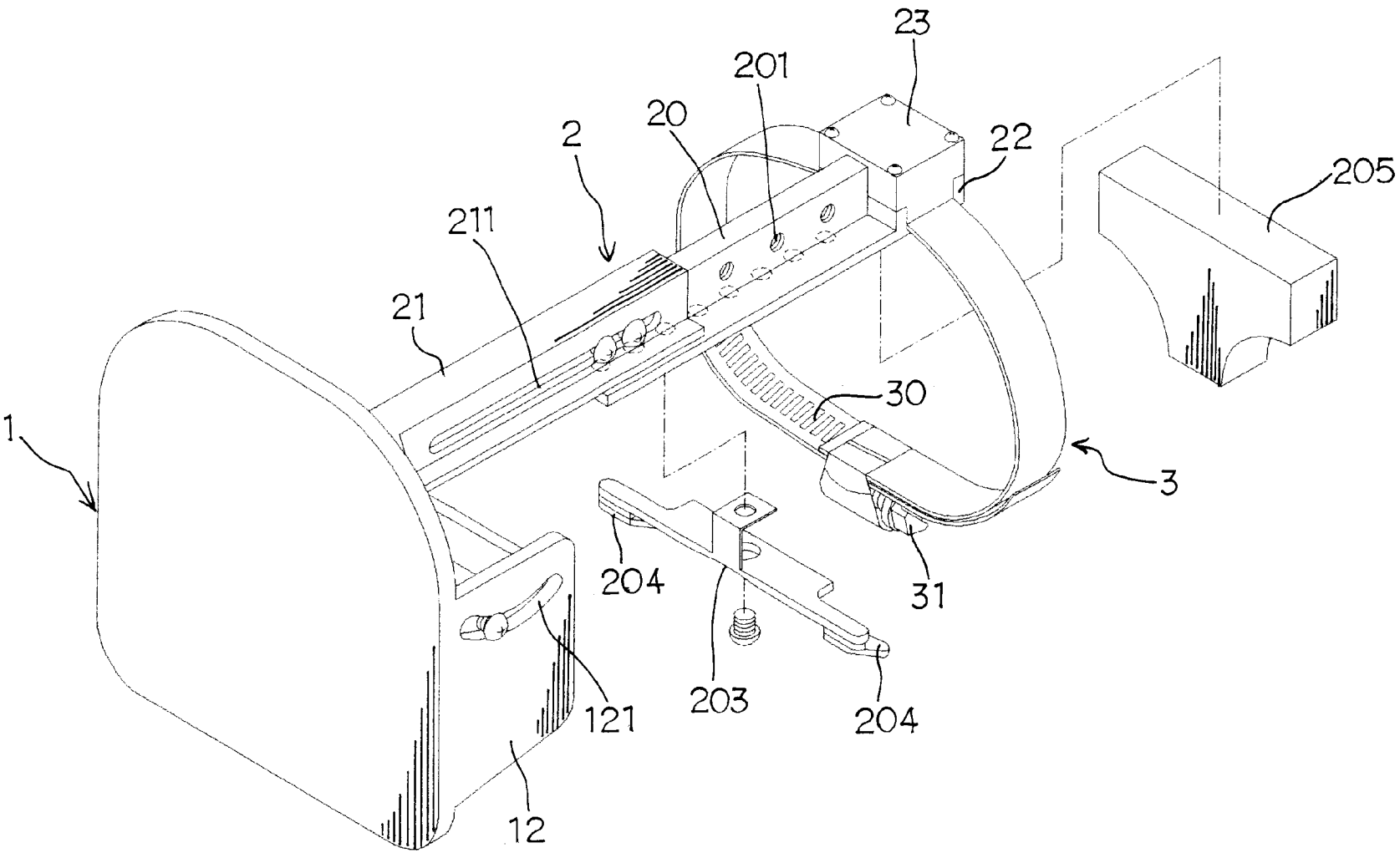
FIG. 13 is a perspective partially exploded view of a seventh embodiment of the present invention.
Figure 14:
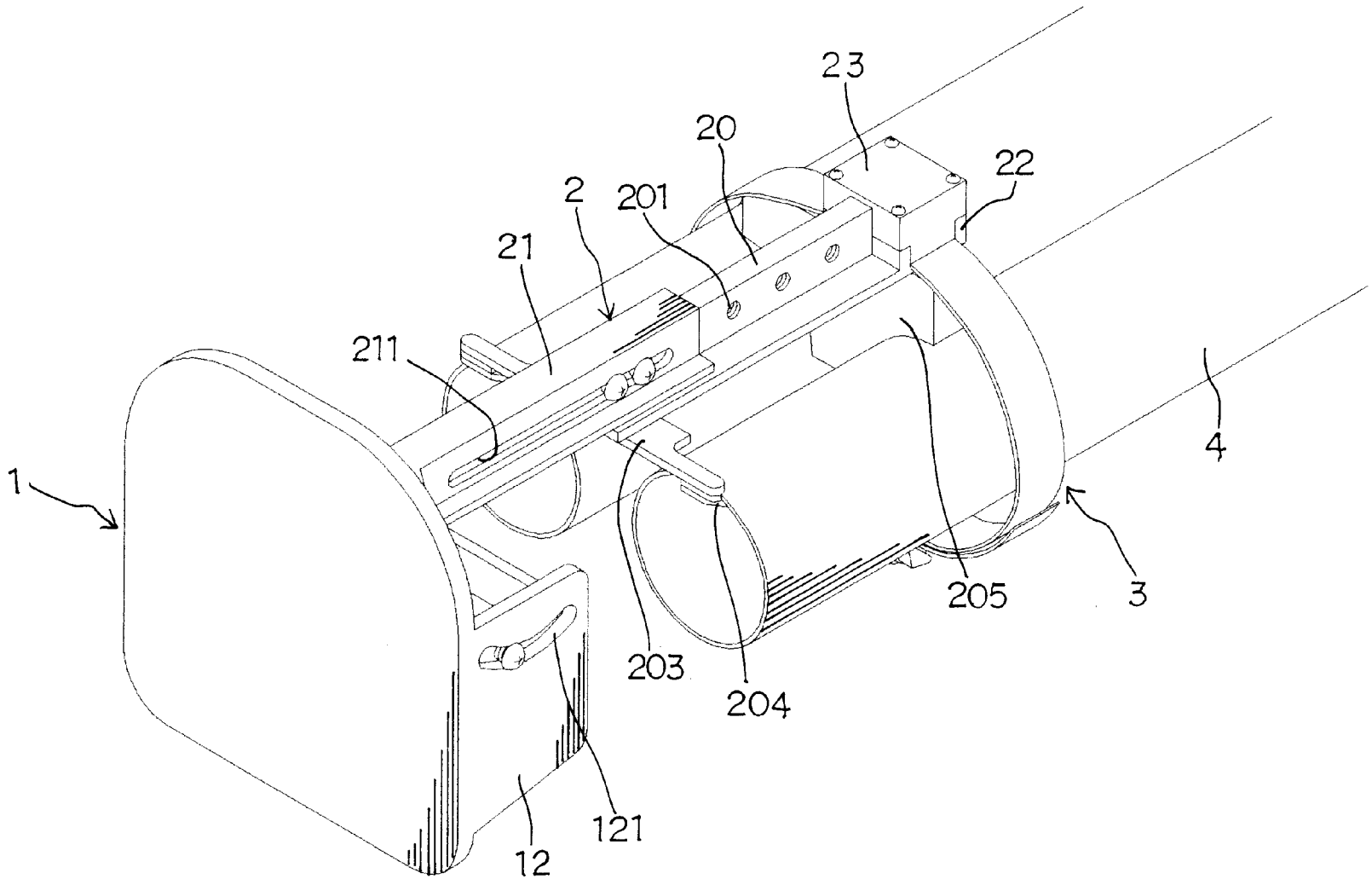
FIG. 14 is a perspective assembled view according to FIG. 13, showing the application of the seventh embodiment of the present invention to a car exhaust pipe with double pipes.

FIGS. 13 and 14 show an embodiment for installation on a double-pipe exhaust pipe structure 4. The decorative structure includes identical panel block 1, adjusting unit 2 and fastening ring 3 and is only different from the above embodiments in that the restricting member 203 under the fixing bar 20 has two stop sections 204 laterally extending from the center of the main body for engaging with the ends of the walls of the double exhaust pipes. Accordingly, the fastening ring 3 is fitted around the double exhaust pipes 4 with the ends of the walls of the double exhaust pipes 4 abutting against the restricting member 203. At this time, the stop sections 204 of the restricting member 203 extend into the double exhaust pipes 4 and engage therewith. Then the screw adjuster 31 is used to truly fasten the decorative structure on the double exhaust pipes 4. Under such circumstance, an additional reverse triangular block 205 can be filled in the space between the fastening ring 3 and the double exhaust pipes 4 so as to more firmly install the decorative structure.

The above embodiments are only used to illustrate the present invention, not intended to limit the scope thereof. Many modifications of the above embodiments can be made without departing from the spirit of the present invention.

What is claimed is:

1. Decorative structure for car exhaust pipe, comprising:

a panel block for a decorative picture piece to dispose on a surface thereof, a back face of the panel block being formed with thread holes at which a pivot block is locked, two sides of the back face of the panel block being formed with connecting wings opposite to each other, each connecting wing being formed with an arch slot;

an adjusting unit including a fixing bar having a reverse T-shaped cross-section and a slide bar having a reverse U-shaped cross-section, the fixing bar and the slide bar being fitted with each other, a central swelling section of the fixing bar being formed with multiple through locating holes, a bottom face of the fixing bar being formed with multiple shallow circular dents, one end of the fixing bar being formed with a fixing section having a recess with arch face for a fastening ring to inlay, a fixing block being mated with the arch face and locked in the recess by screws, two lateral sides of the slide bar being formed with slots corresponding to the locating holes, one end of the slide bar being formed with a pair of lugs having aligned through holes, a connecting lever being locked under the lugs, two arms of the connecting lever being formed with orifices; and a fastening ring which is a resilient metal sheet which is curled into a hoop, the fastening ring being formed with multiple adjusting bores arranged at equal intervals from one end of the fastening ring by a certain distance, a screw adjuster being disposed at overlapping sections of two ends of the fastening ring, whereby the panel block can be freely swung, the adjusting unit can be adjusted in length and the fastening ring can be adjusted in inner diameter so that the decorative structure can be installed on various specifications and diameters of car exhaust pipes.

2. Decorative structure for car exhaust pipe as claimed in claim 1, wherein a U-shaped restricting member is locked at the shallow circular dent under the fixing bar of the adjusting unit.

3. A decorative structure for a car exhaust pipe comprising:

a) a panel block having a surface for supporting a decorative picture and a pair of opposed wings, each wing including a toothed face formed thereon;

b) an adjusting unit including a fixing bar having a reverse T-shaped cross-section and a slide bar having a reverse U-shaped cross-section, the fixing bar and slide bar being slidably engaged with each other;

c) the fixing bar including a central swelling section provided with a plurality of spaced locating holes, a bottom face having a plurality of spaced shallow circular dents formed therein, an end having a fixing section defined by a recess with an arch face for receiving a fastening ring, and a fixing block mated to the arch face and secured to the fixing section;

d) the slide bar including two lateral sides, a slot formed in one lateral side corresponding to the locating holes, an end provided with a connecting lever having two arms, each arm including a toothed face, the toothed faces of the connecting lever being selectively engagable with the toothed faces of the panel block for adjusting the angle of the panel block relative to the connecting lever; and e) a fastening ring formed of resilient metal curled into a hoop and including a plurality of spaced adjacent bores, a screw adjuster disposed at overlapping sections of a pair of ends of the ring for varying the diameter of the ring to conform the ring to exhaust pipes of different diameters.

4. A decorative structure for a car exhaust pipe comprising:

a) a panel block having a surface for supporting a decorative picture and a pair of semispherical bodies intersecting each other by 90°, each body including a plane face having a toothed configuration formed therein;

b) an adjusting unit including a fixing bar having a reverse T-shaped cross-section and a slide bar having a reverse U-shape cross-section, the fixing bar and slide bar being slidably engaged with each other;

c) the fixing bar including a central swelling section provided with a plurality of spaced locating holes, a bottom face having a plurality of spaced shallow circular dents formed therein, an end having a fixing section defined by a recess with a arch face for receiving a fastening ring, and a fixing block mated to the arch face and secured to the fixing section;

d) the slide bar including two lateral sides, a slot formed in one lateral side corresponding to the locating holes, and an end provided with a pair of semispherical bodies, each semispherical body having a plane face with a toothed configuration formed therein, whereby the toothed faces of the semispherical bodies of the panel block and the toothed faces of the semispherical bodies of the slide bar being selectively engagable with each other for permitting the angle of the panel block to be adjusted relative to the adjusting unit; and e) a fastening ring formed of resilient metal curled into a hoop and including a plurality of spaced adjusting bores, a screw adjuster disposed at overlapping sections of a pair of ends of the ring for varying the diameter of the ring to conform the ring to exhaust pipes of different diameters.

5. A decorative structure for a car exhaust pipe comprising:

a) a panel block having a surface for supporting a decorative picture and a ball body;

b) an adjusting unit including a fixing bar having a reverse T-shaped cross-section and a slide bar having a reverse U-shaped cross-section, the fixing bar and slide bar being slidably engaged with each other;

c) the fixing bar including a central swelling section provided with a plurality of spaced locating holes, a bottom face having a plurality of spaced shallow circular dents formed therein, an end having a fixing section defined by a recess with an arch face for receiving a fastening ring, and a fixing block mated to the arch face and secured to the fixing section;

d) the slide bar including two lateral sides, a slot formed in one lateral side corresponding to the locating holes, an end provided with a body defining a spherical cavity having a pair of lengthwise splits formed in opposed wall portions defining the cavity, the ball body of the panel block being engagable within the spherical cavity for permitting the angle of the panel block to be adjusted relative to the adjusting unit; and e) a fastening ring formed of resilient metal curled into a hoop and including a plurality of spaced adjusting bores, a screw adjuster disposed at overlapping sections of a pair of ends of the ring for varying the diameter of the ring to conform the ring to exhaust pipes of different diameters.

6. A decorative structure for a car exhaust pipe comprising:

a) a panel block having a surface for supporting a decorative picture in a pair of opposed wings, each wing including a toothed face formed thereon;

b) an adjusting unit including a fixing bar, a first end of the fixing bar having a fastening ring integrally formed therewith, a second end of the fixing bar being provided with a connecting lever having two arms, each arm of the connecting lever including a toothed face formed therein, the toothed faces of the panel block being selectively engagable with the toothed faces of the connecting lever for permitting adjusting the angle of the panel block relative to the connecting lever; and c) the fastening ring including a pair of opposed circumferentially extending slits formed therein, and an adjustable clip plate engaged within the slits.

7. A decorative structure for a car having a pair of exhaust pipes comprising:

a) a panel block having a surface for supporting a decorative picture, a back face provided with a plurality of thread holes, a pivot block secured to the thread holes, a pair of opposed wings, each wing having an arch slot formed therein;

b) an adjusting unit including a fixing bar having a reverse T-shaped cross-section and a slide bar having a reverse U-shaped cross-section, the fixing bar and slide bar being slidably engaged with each other;

c) the fixing bar including a central swelling section provided with a plurality of spaced locating holes, a bottom face having a plurality of spaced shallow circular dents formed therein, an end having a fixing section defined by recess with an arch face for receiving a fastening ring, a fixing block mated to the arch face and secured to the fixing section, a restricting member secured to the bottom face of the fixing bar by a fastener selectively engageable within the circular dents, the restricting member including a main body and a pair of stop sections extending laterally from a center of the main body for engaging the ends of a pair of exhaust pipes extending through and secured by a fastening ring;

d) the slide bar including two lateral sides, a slot formed at one lateral side corresponding to the locating holes, an end provided with a connecting lever having two arms, each arm being secured to a wing of the panel block by a fastener extending through the arch slot for permitting varying the angle of the panel body with respect to the adjusting unit; and e) a fastening ring formed of resilient metal curled into a hoop and including a plurality of spaced adjusting bores, a screw adjuster disposed at overlapping sections of a pair of ends of the ring for varying the diameter of the ring to conform the ring to exhaust pipes of different diameters.

* * * * *